United States Patent [19]

Okino et al.

[11] Patent Number: 4,773,375

[45] Date of Patent: Sep. 27, 1988

[54] ELECTRONIC FUEL CONTROL METHOD AND APPARATUS FOR FUEL INJECTION ENGINES

[75] Inventors: Yoshinori Okino; Hiroshi Ebino, both of Hiroshima, Japan

[73] Assignee: Mazda Motor Corporation, Hiroshima, Japan

[21] Appl. No.: 43,045

[22] Filed: Apr. 27, 1987

[30] Foreign Application Priority Data

Apr. 30, 1986 [JP] Japan ..... 61-101299

[51] Int. Cl.[4] ..... F02D 41/18; F02M 51/00

[52] U.S. Cl. ..... 123/488; 123/494; 364/431.05; 364/510

[58] Field of Search ..... 123/486, 480, 494, 488; 364/431.05, 510

[56] References Cited

U.S. PATENT DOCUMENTS

| | | | |
|---|---|---|---|
| 4,264,961 | 4/1981 | Nishimura | 123/494 |
| 4,562,814 | 1/1986 | Abo | 123/494 |
| 4,593,667 | 6/1986 | Sasaki | 123/488 |
| 4,616,621 | 10/1986 | Kuroiwa | 123/488 |
| 4,644,474 | 2/1987 | Aposchanski | 123/494 |
| 4,664,090 | 5/1987 | Kabasin | 123/494 |
| 4,671,242 | 6/1987 | Akiyama | 123/486 |

FOREIGN PATENT DOCUMENTS

| | | | |
|---|---|---|---|
| 0008240 | 1/1983 | Japan | 123/488 |
| 0003132 | 9/1984 | Japan | 123/488 |

*Primary Examiner*—Willis R. Wolfe

*Attorney, Agent, or Firm*—Burns, Doane, Swecker & Mathis

[57] ABSTRACT

A method and apparatus for electronically controlling injection of fuel into an engine selectively uses fuel injection control based on an intake air flow rate sensing system (e.g. L-J system fuel injection control) and fuel injection control based on a speed density system (e.g. D-J system fuel injection control), this depending upon the amount of intake air. In an engine operating region where a control relationship between these two forms of fuel injection control is constant, e.g. in an operating region where the amount of intake air is low, the relationship is stored. In a region of high air intake, where the relationship no longer holds, the amount of fuel injection in the speed density system is corrected on the basis of the aforementioned relationship.

15 Claims, 10 Drawing Sheets

ELECTRONIC FUEL CONTROL METHOD AND APPARATUS FOR FUEL INJECTION ENGINES

BACKGROUND OF THE INVENTION

This invention relates to an electronic fuel control method and apparatus for fuel injection engines.

Conventional electronic fuel control systems for fuel injection engines are classified roughly into so-called intake air flow rate sensing systems and speed density systems. The former measures the amount of intake air directly by using a vane-type or hot wire-type air flow sensor. The latter measures the amount of intake air indirectly based on throttle opening or pressure inside the intake pipe.

A typical example of the intake air flow rate sensing system is the L-Jetronic system (referred to as the "L-J system" hereinafter), characterized by a narrow measurable range of flow rates but exhibiting outstanding measurement precision. More specifically, the L-J system is capable of highly accurate measurement of the amount of intake air in an operating region where the amount of intake air is low. A typical example of the speed density system is the D-Jetronic system (referred to as the D-J system hereinafter), characterized by a broad measurable range of flow rates but exhibiting a lower level of measurement precision than the L-J system. The reason for this is that the amount of intake air fluctuates depending upon the operating state of the engine, the outside air conditions and the like, even though the intake pipe pressure and engine rpm can be measured accurately. This fluctuation becomes especially pronounced in the low rpm region.

Thus, the two aforementioned systems have their advantages and disadvantages but measurement precision is sacrificed at some part of the operating region regardless of which system is adopted.

A fuel control apparatus proposed as a solution to the above problem has been disclosed in Japanese Patent Publication No. 59-7017. The disclosed apparatus has an engine intake air flow rate sensor, an intake pipe internal pressure sensor and an engine rotational speed sensor connected to control means for controlling the amount of fuel injection. Control of the amount of fuel injection based on the intake air flow rate sensing system and control of the amount of fuel injection based on the speed density system are switched between in response to the operating region in such a manner that the advantages of both systems manifest themselves. Specifically, a value indicative of the amount of intake air sensed by the intake air flow rate sensor is used in determining the operating region. In an operating region where the value of the amount of intake air is less than a certain value, a fuel injection valve is operated on the basis of output signals from both the intake air flow rate sensor and engine rotational speed sensor in accordance with the intake air flow rate sensing system. In an operating region where the value of the amount of intake air is greater than a certain value, on the other hand, the fuel injection valve is operated on the basis of output signals from both the intake pipe internal pressure sensor and engine rotational speed sensor in accordance with the speed density system without relying upon the sensed amount of intake air.

With a fuel control apparatus of this type, however, the amount of intake air is "measured" indirectly by calculating the pressure inside the intake pipe in accordance with the speed density system in an operating region in which the intake air flow rate is construed to be high, as described above, and the amount of fuel injection is decided on the basis of the amount of this indirectly "measured" amount of intake air. Consequently, an error develops between the actual amount of intake air and the indirectly "measured" amount of intake air. In other words, an error develops between the actual air-fuel ratio and target air-fuel ratio in the operating region where the intake air flow rate is high. This results in poor fuel efficiency or a deterioration in the exhaust gas characteristic.

SUMMARY OF THE INVENTION

The present invention is proposed as a solution to the aforementioned problems and its object is to reduce the air-fuel ratio control error in the region of high intake air flow rate.

According to the present invention, the foregoing object is attained by correcting the amount of fuel injection in the region of high intake air flow rate on the basis of a relationship between unit intake air flow rates calculated in both the speed density system and intake air flow rate sensing system based on these systems in a region of low intake air flow rate.

Specifically, an apparatus for controlling the amount of fuel injection in accordance with the invention comprises: fuel injection means for injecting fuel to be supplied into an engine; flow rate sensing means arranged in an intake air passageway for sensing the flow rate of air taken into the engine and outputting a first flow rate signal; flow rate signal calculating means for calculating and outputting, on the basis of a signal related to engine load, a second flow rate signal representing the flow rate of air taken into the engine; engine rotational speed sensing means for sensing rotational speed of the engine; decision means for determining whether the general flow rate of air taken into the engine is high or low; first fuel injection amount calculating means for calculating a first fuel injection amount value based on the first flow rate signal and engine rotational speed; second fuel injection amount calculating means for calculating a second fuel injection amount value based on the second flow rate signal and engine rotational speed; arithmetic and memory means operable when the decision means determines that the general air flow rate is low for calculating and storing a relationship between a first unit intake air flow rate per unit of engine revolution calculated based on the first flow rate signal and a second unit intake air flow rate per unit of engine revolution calculated based on the second flow rate signal; corrective value computing means for calculating a corrective value of fuel injection amount based on the relationship stored in the arithmetic and memory means; and control means for performing control in such a manner that the fuel injection mean injects fuel based on the first fuel injection amount value when the decision means determines that the general air flow rate is low and based on the second fuel injection amount value and corrective value when the decision means determines that the general air flow rate is high.

In accordance with this arrangement, the second fuel injection amount in the high-intake air operating state is corrected, and fuel is injection in accordance with the corrected value, on the basis of the relationship between the first unit intake air flow rate and second unit intake air flow rate stored in the low-intake air operating state, or in other words, on the basis of the relationship between the unit air intake flow rates in the speed density system and intake air flow rate sensing system calculated based on these two systems.

In accordance with an embodiment of the control apparatus, the aforementioned relationship is expressed by a ratio or difference between the first and second unit intake air flow rates.

In accordance with another embodiment, the arithmetic and memory means calculates and stores, whenever the decision means determines that the general air flow rate is low, an average of a value indicative of the relationship calculated and stored in a previous cycle and a value indicative of the relationship calculated in the current cycle.

In another embodiment, the decision means determines whether the general air flow rate is high or low based on the first flow rate signal or second flow rate signal.

In still another embodiment, the arithmetic and memory means calculates and stores the aforementioned relationship only when the decision means determines that the general air flow rate, obtained based on the second flow rate signal and engine rotational speed, has an intermediate value.

In yet another embodiment, the second flow rate signal is an intake air pressure value downstream of a throttle valve, or a throttle valve opening value.

A method of controlling a fuel injection amount in accordance with the invention comprises: a first step of determining whether a general flow rate of air taken into an engine is high or low; a second step of executing steps (a) through (f) when the general flow rate is determined to be low in the first step, and a third step of executing steps (p) through (s) when the the general flow rate is determined to be high in the first step, (a) being a step of measuring the flow rate of air taken into the engine through an intake air passageway, (b) being a step of calculating the flow rate of intake air supplied to the engine on the basis of a signal relating to engine load, (c) being a step of calculating a first unit intake air amount per unit revolution of the engine based on the amount of intake air measured in step (a), calculating a second unit intake air amount per unit revolution of the engine based on the amount of intake air calculated in step (b), and calculating a relationship between these first and second unit intake air amounts, (d) being a step of storing the relationship calculated, (e) being a step of calculating a first fuel injection amount based on the intake air amount calculated in step (a) and engine rotational speed, and (f) being a step of injecting fuel from fuel injection means based on the first fuel injection amount; (p) being a step of calculating the flow rate of air taken into the engine based on a signal relating to engine load, (q) being a step of correcting the intake air flow rate calculated in step (p) based on the relationship stored in the step (d), (r) being a step of calculating a second fuel injection amount based on the corrected intake air flow rate and engine rotational speed, and (s) being a step of injecting fuel from the fuel injection means based on the second fuel injection amount.

According to an embodiment of this control method, the relationship calculated in step (c) is expressed by a ratio or difference between the first and second unit intake air flow rates.

In accordance with another embodiment, the step (d) includes calculating and storing an average of a value indicative of the relationship stored in step (d) of a previous cycle and a value indicative of the relationship calculated in step (c) of the current cycle.

In another embodiment, the first step includes determining whether the general air flow rate is high or low by comparing the value of the signal relating to engine load with a predetermined threshold value.

In still another embodiment, the signal relating to engine load in step (a) is a pressure value in an intake pipe downstream of a throttle valve of the engine, or a throttle valve opening value.

In accordance with a further embodiment, the step (d) includes determining whether the general air flow rate, obtained based on the value of the signal relating to the engine load and engine rotational speed, is in a region of intermediate values, and storing the aforementioned relationship only when it is determined that the general air flow rate is in said region.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

Principle

Figure 1:
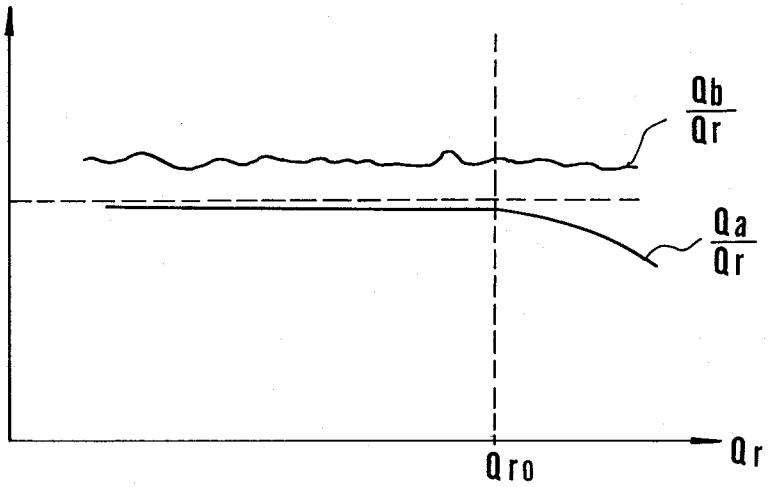
FIG. 1 is a graphical representation for describing the principle of a fuel control method according to the present invention.

The principle on which the fuel control apparatus of the invention is based will now be described with reference to FIG. 1, in which $Q_r$ represents the amount of air which actually flows into an engine, $Q_a$ an amount of intake air calculated based on the intake air flow rate sensing system, and $Q_b$ an amount of intake air calculated based on the speed density system. In actuality, $Q_a$ is an output voltage signal from the sensor of the intake air flow rate sensing system and directly reflects the amount of intake air in milliliters. On the other hand, $Q_b$ is an output voltage signal from the sensor of the speed density system and represents e.g. the value of pressure (mmHg) inside the intake pipe, indirectly reflecting the amount of intake air. In the field of electronic fuel control, these voltage signals are used as a basis for calculating the amount of fuel injection on the premise that they reflect the amount of intake air. Accordingly, the principle shall be described using $Q_a$, $Q_b$ as the amount of intake air.

In the intake air flow rate sensing system, a vane-type or other suitable sensor is used as an intake air measuring instrument for directly measuring the amount of intake air in the intake air passageway, as described above. Therefore, $Q_a/Q_r \approx 1$ is considered to hold in an operating region where the amount of intake air is less than a certain predetermined value of intake air amount ($Q_r < Q_{r0}$). In the intake air flow rate sensing system, however, the relationship between $Q_a$ and $Q_r$ is unpredictable in an operating region where the amount of intake air is greater than $Q_{r0}$($Q_r \geqq Q_{r0}$).

In the speed density system, on the other hand, regardless of the fact that the actual amount of intake air $Q_r$ varies due to e.g. the outside air conditions, the value of $Q_b$ calculated from e.g. pressure inside the intake air pipe does not follow up such variation. Consequently, $Q_b/Q_r$ varies as shown in FIG. 1. However, since the range of variation per se due to the external air conditions or the like is constant, the range of variation of $Q_b/Q_r$ is approximately constant in both the operating region below $Q_{r0}$ and the operating region above $Q_{r0}$. This fact illustrates the following:

For $Q_r < Q_{r0}$, $$\overline{(Q_a/Q_r)} : \overline{(Q_b/Q_r)} \approx \overline{(Q_a/Q_b)} \approx \text{constant}$$

where "——" represents an average value. Thus, since $Q_r \approx Q_a$ may be considered to hold for $Q_r < Q_{r0}$, we should be able to write the above equation as follows:

$$\overline{(Q_a/Q_b)} \approx \overline{(Q_r/Q_b)} \approx \text{constant}$$

Accordingly, in an operating region where $Q_r < Q_{r0}$ holds, $\overline{(Q_a/Q_b)}$ is calculated and stored while fuel injection control is being performed in accordance with the intake air flow rate sensing system. Storing the value of $\overline{(Q_a/Q_b)}$ means storing the value of $\overline{(Q_r/Q_b)}$, and the relationship $\overline{(Q_r/Q_b)} \approx$ constant is considered to hold even in the operating region $Q_r \geqq Q_{r0}$ where $Q_a/Q_r \approx 1$ no longer holds, as will be understood from FIG. 1.

Accordingly, in the operating region $Q_r \geqq Q_{r0}$, a value near the actual amount of intake air $Q_r$ can be calculated from $Q_b$ measured in accordance with the speed density system and the stored value of $\overline{(Q_a/Q_b)} \approx \overline{(Q_r/Q_b)}$. That is, $$\overline{(Q_a/Q_b)} \times Q_b \approx \overline{(Q_r/Q_b)} \times Q_b \approx Q_r$$

Therefore, if the value $Q_r$ of intake air amount thus calculated is used in the calculation of the amount of fuel injection, then an air-fuel ratio close to the target air-fuel ratio can be obtained.

In the above description, $\overline{(Q_a/Q_b)}$ in the operating region $Q_r < R_{r0}$ is calculated and stored. However, $Q_a$, $Q_b$ are the amounts of intake air per unit time. In engine fuel injection control, the amount of air intake or the amount of fuel injection (fuel injection pulse width $\tau$) per revolution of the engine is important. Accordingly, instead of storing $\overline{(Q_a/Q_b)}$, it is permissible to store a ratio $\overline{(\tau_L/\tau_D)}$ of the amount of fuel injection (represented by the fuel injection pulse width $\tau_L$ in the following embodiments) based on the intake air flow rate sensing system to the amount of fuel injection (represented by the fuel injection pulse rate $\tau_D$) based on the speed density system in the operating region where $Q_r < Q_{ro}$ holds. Then, when there is a transition to $Q_r > Q_{r0}$, a correction is applied, based on the value of the stored ratio, to the fuel injection amount $\tau_D$ calculated in accordance with the speed density system.

Thus, in connection with the calculation and storage of the "relationship" between control in one system and control in the other system in accordance with the invention, it is permissible to store the "relationship" between the amounts of intake air per unit time measured in the two systems, the "relationship" between the amounts of intake air per engine revolution measured in the two systems, or the "relationship" between the fuel injection amounts per engine revolution measured in the two systems, in which the fuel injection amounts are themselves the object of control.

Further, the ratio $\overline{(Q_a/Q_b)}$ of the amounts of intake air, or the ratio $\overline{(\tau_L/\tau_D)}$ of the amounts of fuel injection, represents the "relationship" between the amounts of intake air (or the amounts of fuel injection) calculated on the basis of the speed density system and intake air flow rate sensing system. Therefore, the relationship can be expressed not only by a ratio but also by a difference between the two quantities.

In the description of FIG. 1, the determination of the prevailing operating region is made based on the actual value of $Q_r$. However, measurement of the actual value of $Q_r$ is in fact impossible, and determination of the operating region does not require to be done with great precision. Accordingly, the determination can be made based on $Q_a$ or $Q_b$. It is preferred that $Q_b$ be used since the value thereof undergoes little sudden fluctuation over a wide operating range.

The principle of fuel injection control and various modifications thereof have been described in conjunction with FIG. 1. In the embodiments that follow, the "relationship" between the amount of fuel injection in the speed density system and the amount of fuel injection in the intake air flow rate sensing system will be expressed by the "ratio".

General Features of the Fuel Control System

Figure 2:
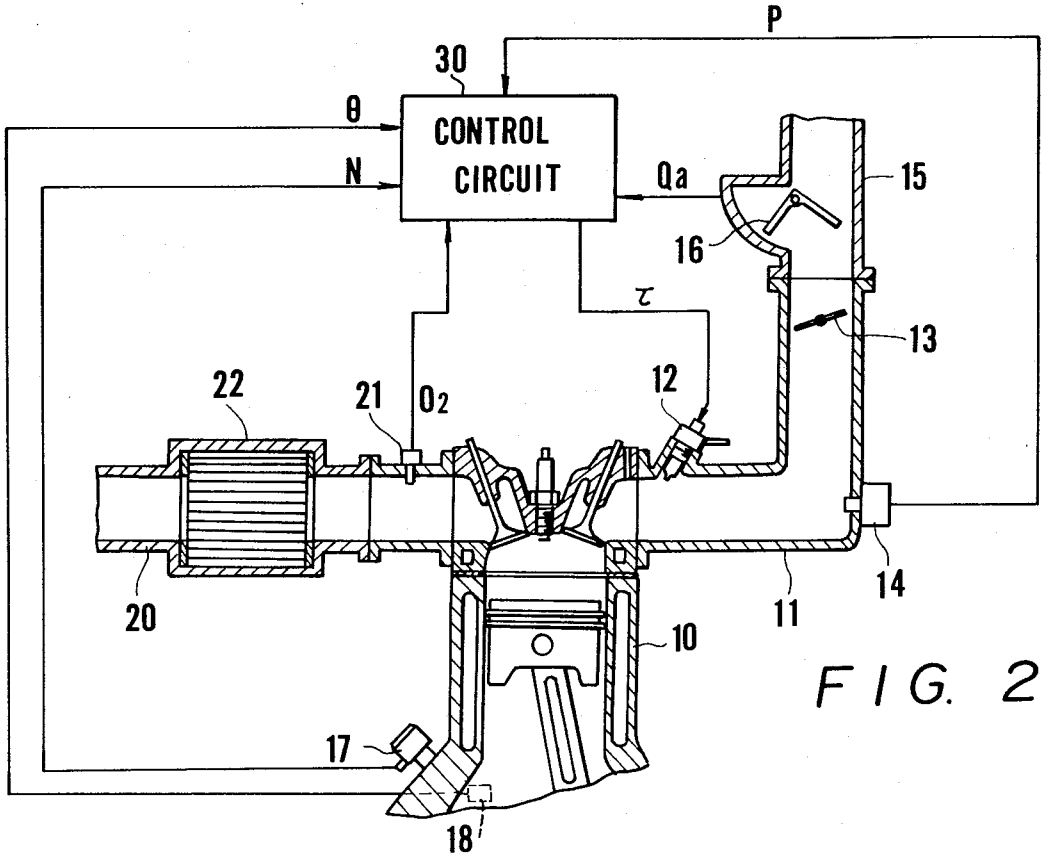
FIG. 2 is a view showing the overall construction of a fuel injection control system to which the present invention is applied.

FIG. 2 is an overall systematic view of an embodiment in which the fuel control apparatus of the invention is applied to an automobile engine. In the system of FIG. 2, an injector 12 mounted on an intake manifold 11 is supplied with fuel highly pressurized by a fuel pump (not shown) and regulated to a constant pressure in dependence upon intake air pipe pressure (sensed by a sensor 14 and represented by a signal P) inside the manifold 11. The amount of fuel injected by the injector 12 is controlled by a drive pulse $\tau$ outputted by a fuel control circuit 30 in such a manner that an optimum air-fuel ratio is obtained in dependence upon the engine operating condition. The intake manifold 11 has an upstream end provided with a throttle valve 13 and a mid-portion provided with the sensor 14 for sensing pressure inside the intake air pipe and outputting the signal P. An intake pipe 15 connected to the upstream side of the intake manifold 11 is provided with an intake air measuring instrument 16 comprising a pivoted measuring vane rotated in response to the dynamic pressure of intake air to output a signal $Q_a$ indicative of the amount of intake air and having a voltage corresponding to the angle of vane rotation. The engine has a main body 10 provided with an engine rotational speed sensor 19, which is incorporated in a distributor 17, for outputting a signal N indicative of engine rotational speed, and a crank angle sensor 18 for outputting a crank angle signal $\theta$. An exhaust pipe 20 is provided with an oxygen concentration sensor 21 for successively sensing the concentration of oxygen in exhaust gas on the downstream side, and a catalytic converter 22 for purifying the exhaust gas.

The fuel control circuit 30 employs both the aforementioned D-J system typifying the speed density system and the L-J system typical of the intake air flow rate sensing system. In an operating region where a constant "relationship" described in connection with FIG. 1 is established between the amounts of fuel injection measured in the D-J and L-J systems, the fuel injection amount $\tau_L$ is decided in accordance with the L-J system while the "relationship" is calculated and stored. In an operating region where the aforementioned constant relationship does not hold, a fuel injection amount $\tau_{DO}$ in accordance with the D-J system is corrected based on the calculated and stored constant "relationship".

Figure 4:
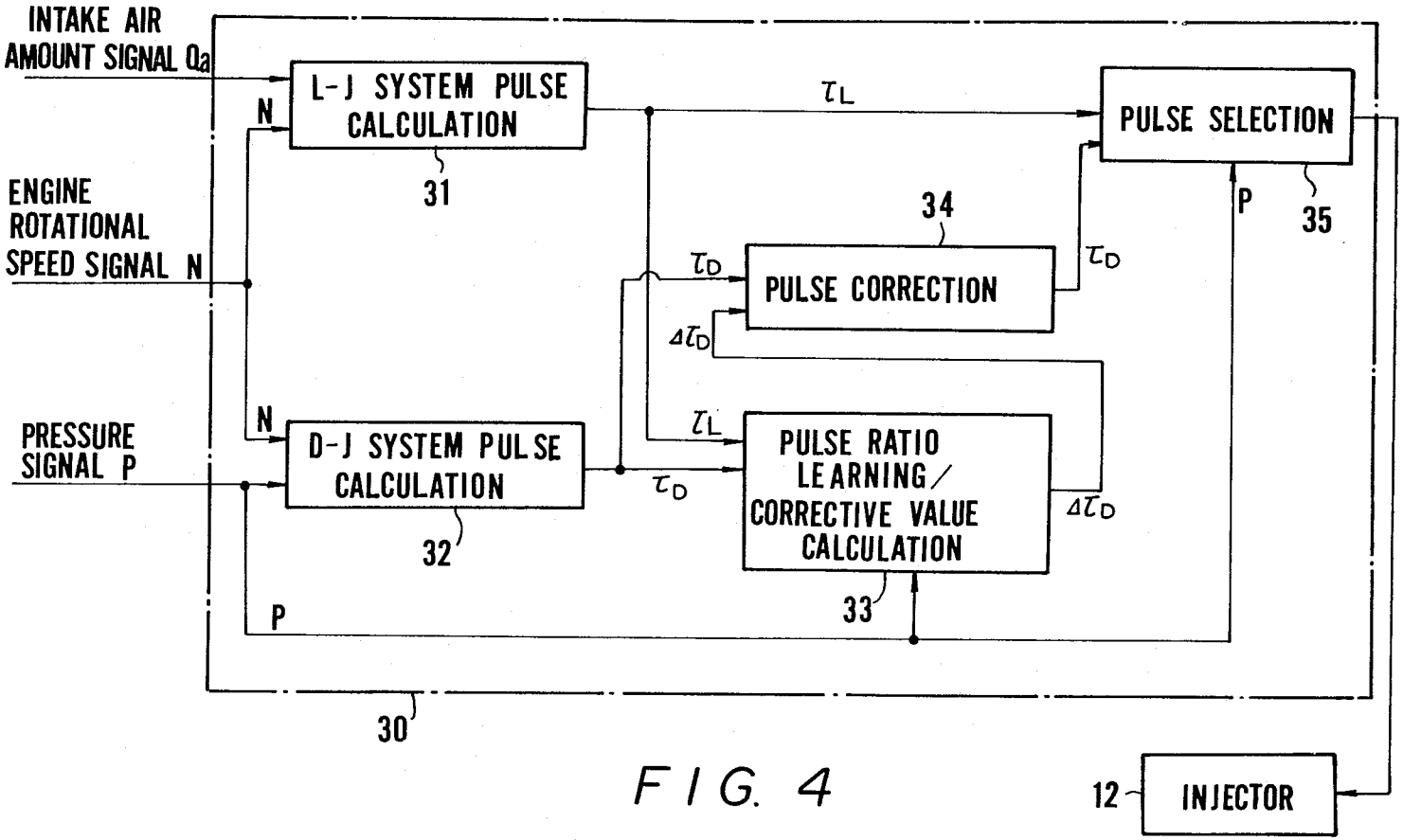
FIG. 4 is a functional block diagram of a first embodiment of fuel control.
Figure 6:
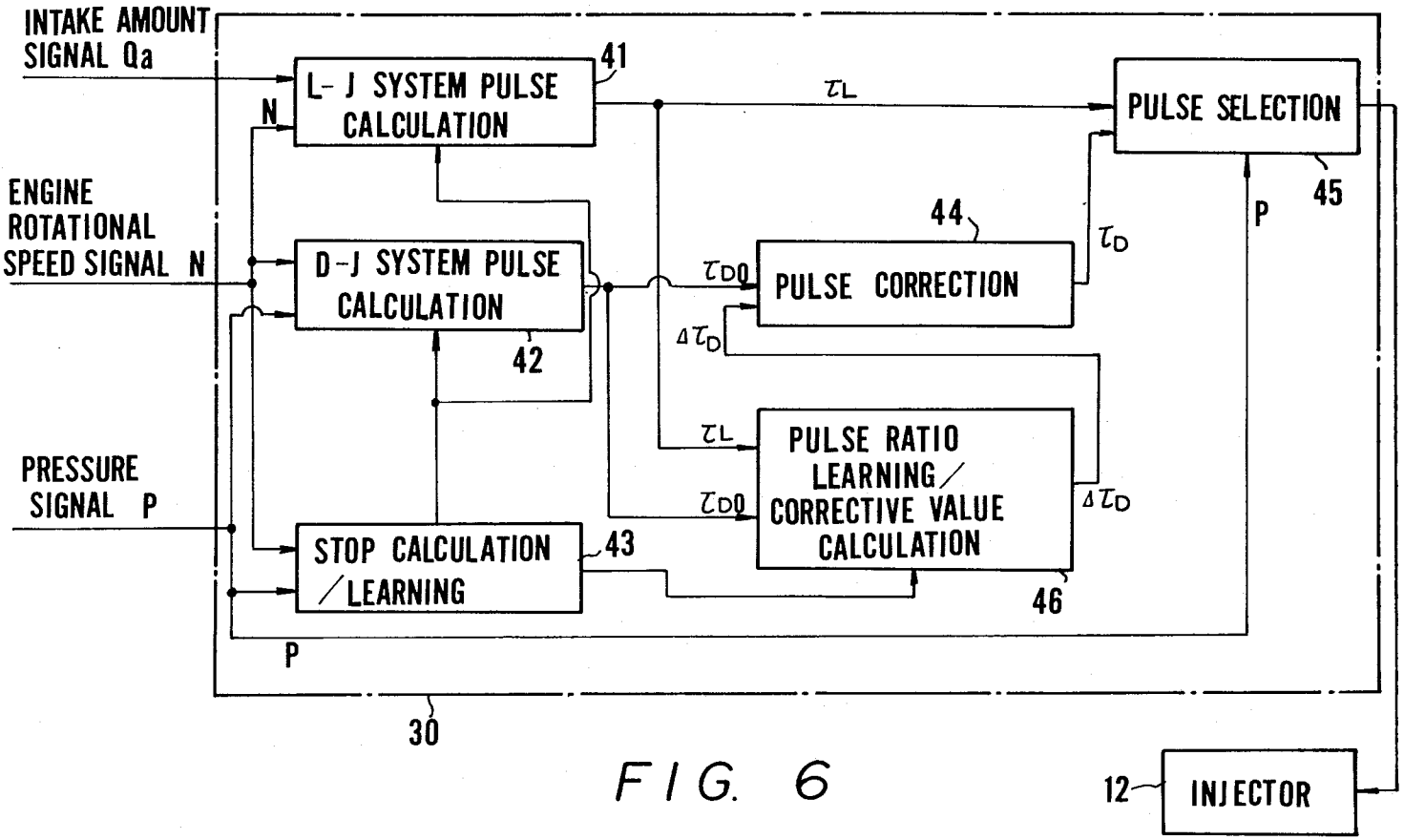
FIG. 6 is a functional block diagram of a second embodiment of fuel control.

FIG. 4 is a functional block diagram of control according to a first embodiment in which only the pressure signal P from the sensor 14 is used as determination information in order to determine whether the aforementioned constant "relationship" holds and the operating region is one in which this "relationship" is stored. FIG. 6 is a functional block diagram of control according to a second embodiment in which the determination regarding the operating region is made based on the pressure signal P and engine rotational speed signal N.

Figure 3:
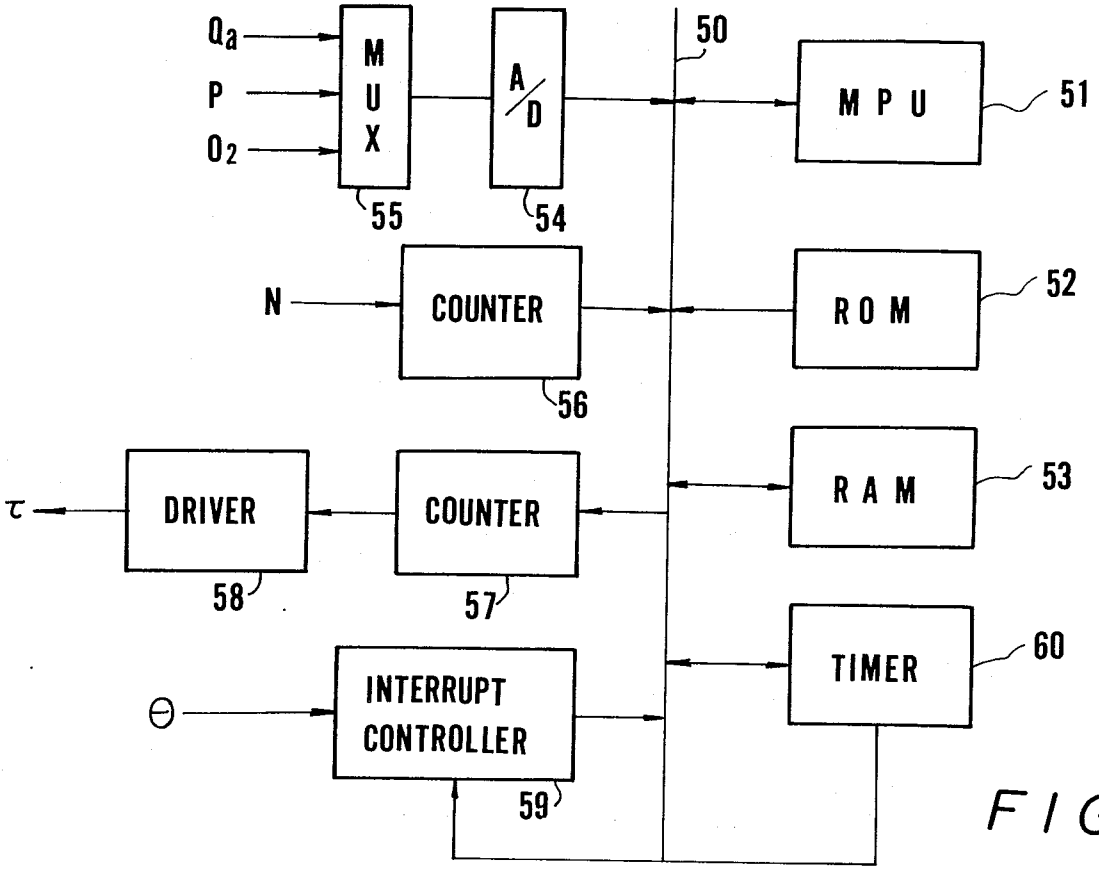
FIG. 3 is a block diagram of a control circuit embodying the present invention.

FIG. 3 is a detailed block diagram illustrating the internal construction of the control circuit 30. MPU 51 is a microprocessor which executes control of the overall circuitry. A control program executed by the microprocessor is stored in a ROM 52. A RAM 53 is for temporarily storing intermediate data such as the aforementioned constant "relationship". The various signals shown in FIG. 2 are inputted to or outputted from the control circuit 30. Among the input signals, an analog voltage signal indicating the amount of intake air $Q_a$ and the analog pressure signal P are selectively inputted by a multiplexer 55 and converted into digital values by an A/D converter 54 before being stored in the RAM 53. The engine rotational speed signal N is inputted to a counter 56. The MPU 51 is informed of engine rpm based on the value in counter 56 by a timer interrupt performed at a predetermined time interval by a timer 60. A signal $\theta$ indicative of crank rotational angle is inputted to an interrupt controller 59. When the crankshaft attains a fixed phase angle, an interrupt is applied to the MPU 51.

When a fuel injection pulse width is decided by the MPUT 51 based on a predetermined calculation, the value is inputted to a counter 57 and a driver 58 is actuated to drive the injector 12 until the counter 57 overflows.

First Embodiment of Fuel Control

A first embodiment of fuel control will now be described with reference to FIG. 4, which is a functional block diagram for explaining the control procedure. In the first embodiment, fuel injection pulse widths are calculated simultaneously in blocks 31, 32 in accordance with both the L-J system and D-J system over the entire operating range. The former pulse width is $\tau_L$ according to the L-J system and the latter is $\tau_{DO}$ according to the D-J system. When it is determined that the operating region is a region of a low amount of intake air, the pulse width $\tau_L$ in the L-J system is precise enough for control of air-fuel ratio. Accordingly, $\tau_L$ is selected in a block 35 and the injector 12 is driven in accordance with this pulse width.

The block 33 is adapted to store the ratio of $\tau_{DO}$ to $\tau_L$ cumulatively only if the pressure signal P is indicative of an operating region of a low amount of intake air, and to calculate a corrective value $\Delta\tau_D$ for the fuel injection pulse width $\tau_D$ of the D-J system in preparation for a transition to an operating region of a high amount of intake air. Thus, the block 33 performs information processing by adopting or rejecting pulse width information under various operating conditions and extracting puls width information only when prescribed operating conditions prevail. In other words, the block 33 performs a learning function to prepare for a future change in operating conditions.

When there is a transition to an operating region of a low amount of intake air, $\tau_{DO}$ calculated in block 32 is not all that accurate but has a higher accuracy than $\tau_L$. In addition, learning in connection with $\tau_D$ in block 33 is no longer performed. In block 34, $\Delta\tau_D$ held in block 33 is used as a corrective value to apply a correction to $\tau_{DO}$. When the fuel injection pulse width $\tau_D$ following correction is made $\tau_D$, the latter is selected as the actual injection pulse width in a block 35.

Figure 5:
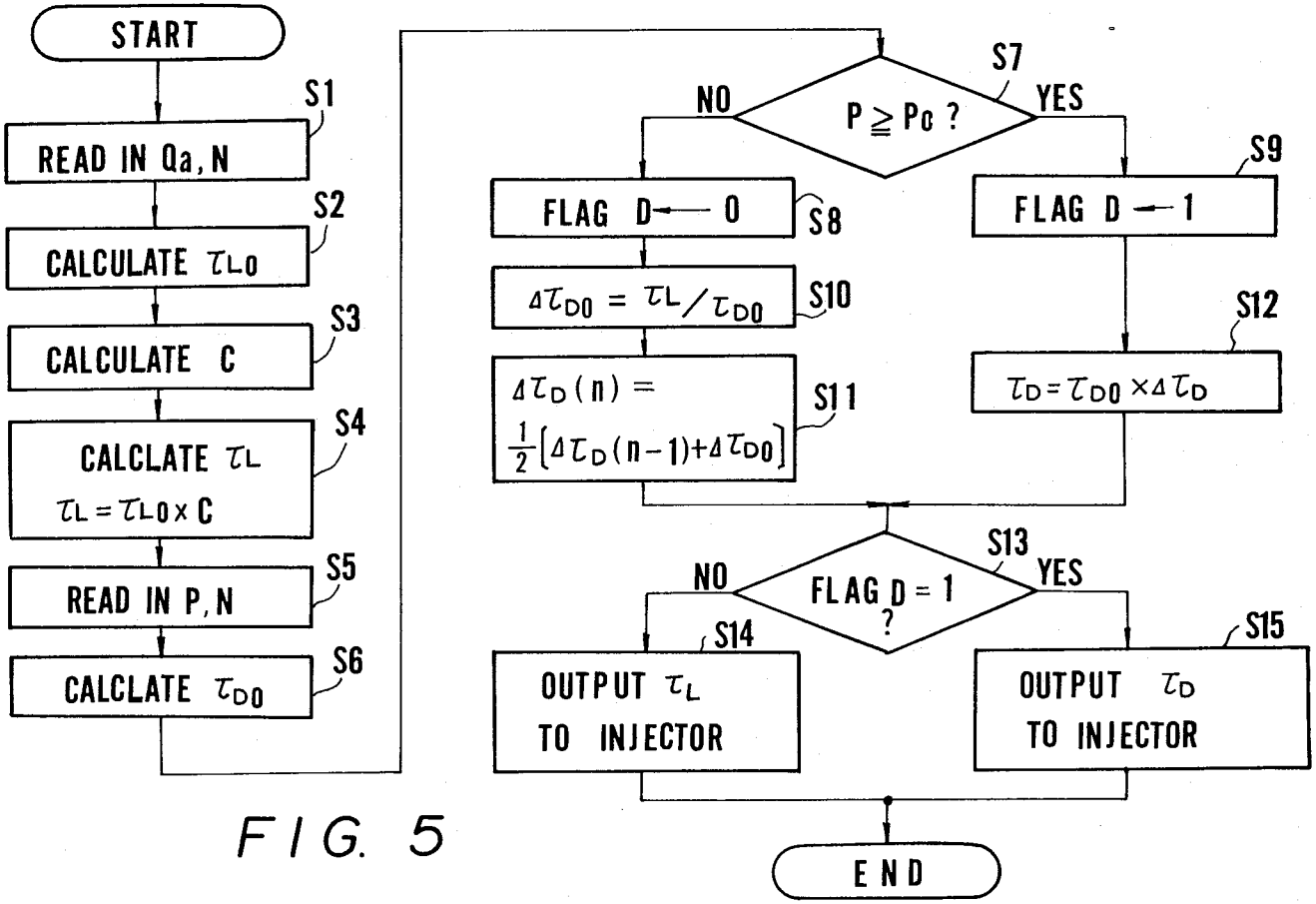
FIG. 5 is a flowchart illustrating the control procedure of the first embodiment.

FIG. 5 illustrates a flowchart of the control procedure in a case where the control operations shown in FIG. 4 are implemented by the digital circuitry shown in FIG. 3. The control program is stored in ROM 52 (FIG. 3).

The control procedure of FIG. 5 starts when the interrupt controller 59 informs the MPU 51 of the fact that the crank angle has attained the predetermined phase angle. In response to the interrupt, the MPU 51 reads in the signal $Q_a$, which is indicative of the amount of intake air sensed by the sensor 16, from the A/D 54, and reads in the engine rotational speed signal N from the counter 56 (step S1). A basic injection pulse $\tau_{LO}$ for driving the injector 12 is calculated in accordance with the L-J system (step S2). The $\tau_{LO}$ data are stored in e.g. ROM 52 beforehand and are read out in accordance with the values of $Q_a$ and N. Next, an air-fuel ratio corrective value C corresponding to the engine rotational speed N is calculated in accordance with a predetermined program (step S3). The corrective value C takes into account engine coolant temperature, intake air temperature and the like and is stored beforehand in the ROM 52 in the form of a map.

Next, the basic pulse $\tau_{LO}$ is corrected in accordance with $\tau_L = \tau_{LO} \times C$, and the injector drive pulse $\tau_L$ in the L-J system is calculated (step S4).

The pressure signal P is inputted from the A/D 54, and the engine rotational speed signal N is inputted from the counter 56 (step S5), after which the basic injection pulse $\tau_{DO}$ in accordance with the D-J system is calculated (step S6). Thus are calculated the fuel injection pulses $\tau_L$, $\tau_{DO}$ in accordance with the L-J and D-J systems. Let us consider a case where the rotational speed of the engine gradually rises from a low to a high rpm region, which is accompanied by a gradual rise in the amount of intake air.

The currently prevailing value of the pressure signal P and a predetermined threshold value $P_0$ are compared at a step S7, where it is determined whether the present operating region is a region of a high air intake ($P \geqq P_0$) or low air intake ($P < P_0$). In terms of the discussion rendered in connection with FIG. 1, $P_0$ is a value considered to correspond to $Q_{r0}$.

If it is determined that the operating region is one of low air intake, then a flag D for identifying the operating state is set to "0" at a step S8. This is followed by a step S10, at which the ratio $\Delta\tau_{DO}$ $(=\tau_L/\tau_{DO})$ of the injector drive pulse $\tau_L$ in the L-J system to the injector drive pulse $\tau_{DO}$ in the D-J system is calculated. The ratio $\Delta\tau_{DO}(=\tau_L/\tau_{DO})$ corresponds to $Q_a/Q_b$ in FIG. 1. Next, at a step S11, the corrective value $\Delta\tau_D(n-1)$, calculated at the preceding interrupt processing and stored in the RAM 53, is read out, the average value of $\Delta\tau_D(n-1)$ and $\Delta\tau_{DO}$ is calculated, and the average value is stored in a corrective value storage area of RAM 53. Specifically, $\Delta\tau_D(n)=[\Delta\tau_D(n-1)+\Delta\tau_{DO})]/2$.

Since the flag D is "0", the program proceeds from a step 13 to a step 14, at which fuel is injected from the injector 12 in response to the L-J system injection pulse $\tau_L$ calculated at step S4.

During the period of time that the operating region is that of low air intake ($P<P_0$), fuel is injected from the injector 12 for a time corresponding to the pulse width of $\tau_L$ while the corrective value based on the ratio indicating the "relationship" between $\tau_L$ and $\tau_D$ is learned, this being performed whenever the MPU 51 receives an interrupt intaking that the crank phase angle has attained a predetermined value.

As the engine rotational speed rises, there is an eventual transition to the region of high air intake ($P\geqq P_0$). When this occurs, the program proceeds from the step S7 to a step S9. This means that the prevailing operating region is one of high air intake, so that the flag D is set to "1" in order to indicate that fuel is to be injected in accordance with $\tau_D$. This is followed by a step S12, at which a final injection pulse width $\tau_D$ is decided in accordance with $\tau_D=\tau_{DO}\cdot\Delta\tau_D$ using the corrective value $\Delta\tau_D$ learned and stored when the operating region was that of low air intake for the purpose of correcting $\tau_{DO}$ calculated at step S6. Since $\tau_D$, while being in accordance with the D-J system, also takes into account the corrective value $\Delta\tau_D$ learned in the region of low air intake, the pulse width corresponds to an amount of intake air close to the actual amount of intake air in the operating region of high air intake. As a result, an air-fuel ratio very near that of the target value is attained.

Second Embodiment of Fuel Control

Figure 7A:
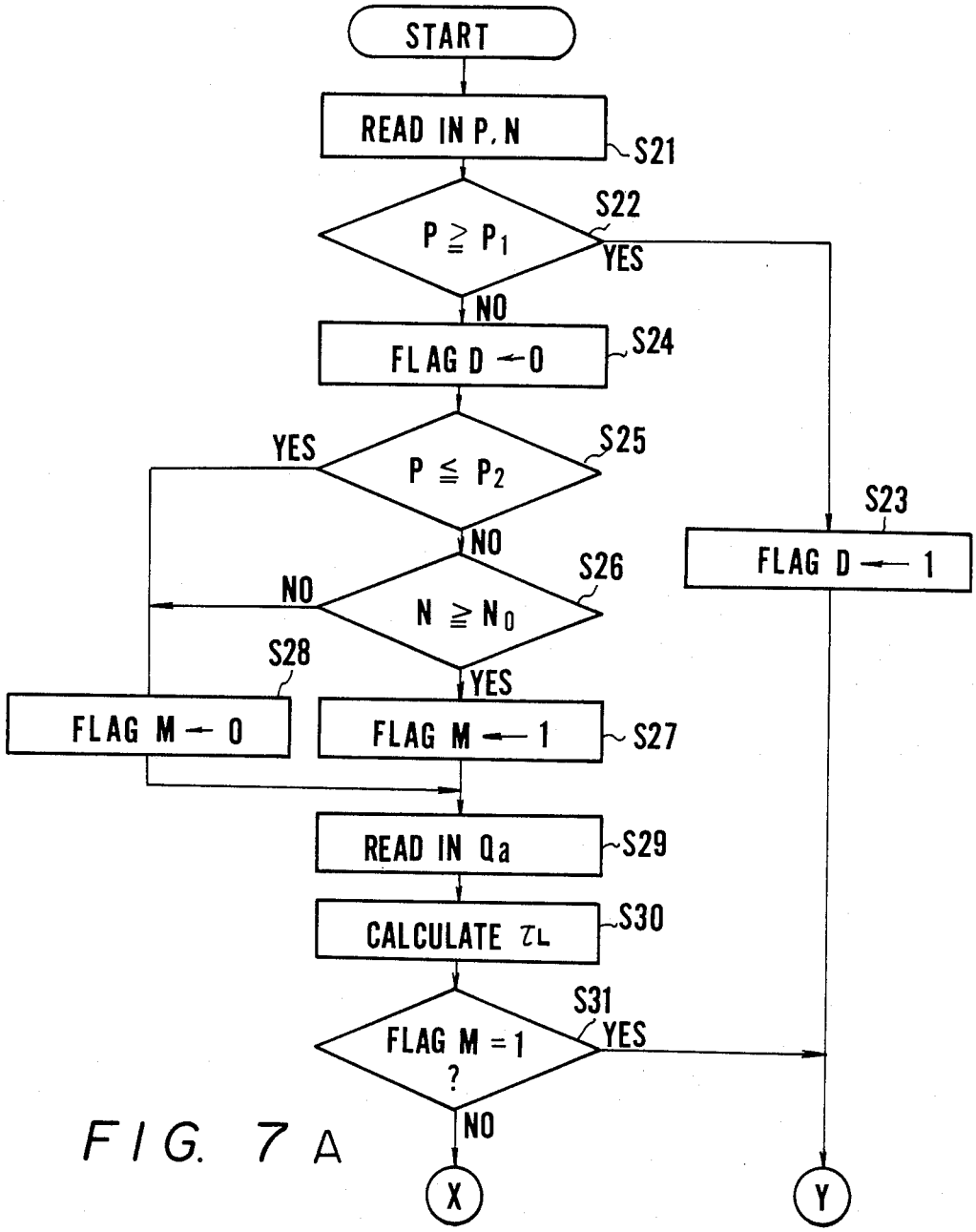
FIGS. 7A and 7B are flowcharts illustrating the control procedure of the second embodiment.
Figure 7B:
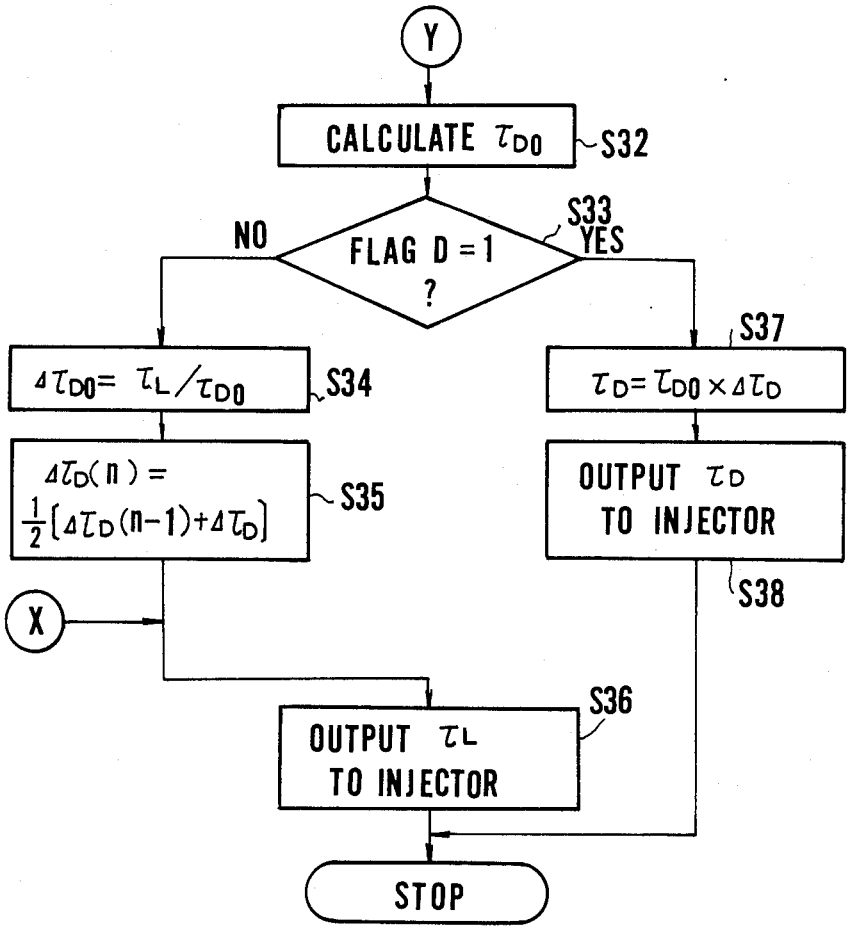

Fuel injection control in accordance with a second embodiment of the invention employs the circuitry of FIG. 2 and is implemented by storing the control program illustrated in FIG. 7 in the ROM 52. A functional block diagram expressing the control procedure is illustrated in FIG. 6.

Figure 8:
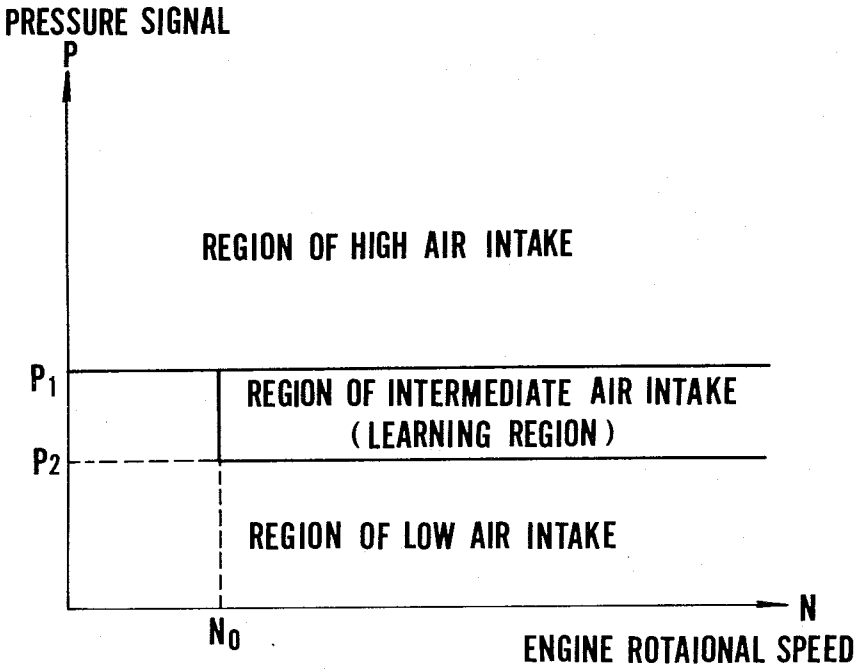
FIG. 8 is a view showing various operating regions in the second embodiment.

In the control procedure according to the first embodiment, the determination regarding the operating region was based solely on the value of the pressure signal P. Further, the learning of the corrective value $\Delta\tau_D$ was performed over the entire operating region of low air intake ($P<P_0$). The control procedure according to the second embodiment is characterized in that the determination regarding the operating region is performed on the basis of engine rotational speed N and pressure signal P, as shown in FIG. 8, the learning of the corrective value $\Delta\tau_D$ is performed solely in a region of intermediate flow rate in FIG. 8 ($N>N_0$, $P_2<P<P_1$) and is not performed in other operating regions. In the regions of low/intermediate air intake, fuel injection control is performed in accordance with the L-J system. In the region of high air intake, fuel injection control is performed in accordance with the D-J system. The learning region is limited to the region of intermediate flow rate because it is believed that a variation in the "relationship" ($Q_a/Q_b$) in description of FIG. 1) between the output signal $Q_a$ from sensor 16 and the output of the sensor 14 is minimized in the intermediate region. Since learning is thus limited to the intermediate region, it is no longer necessary to calculate $\tau_{DO}$ in the operating region of low air intake and $\tau_{LO}$ in the region of high air intake. In other words, control in accordance with the second embodiment hastens processing by dispensing with these calculations.

The functional block diagram of FIG. 6 is basically the same as that of the first embodiment shown in FIG. 4, the only difference being the provision of a block 43 for preventing D-J system pulse calculation unnecessary in the operating region of low air intake, L-J system pulse calculation unnecessary in the operating region of high air intake, and learning unnecessary in these operating regions.

The control procedure according to the second embodiment will now be described based on the flowchart of FIG. 7.

When the program proceeds to a step S21 in response to an interrupt, the pressure signal P and engine rotational speed N are read in at this step. Next, the currently prevailing pressure P inside the intake pipe is compared with a pressure value $P_1$ indicating the boundary between the operating region of high air intake and the operating region of intermediate air intake at a step S22, thereby determining whether the operating region is that of the high air intake. If it is determined that the engine is operating in the region of high air intake ($P\geqq P_1$), a flag D is set to "1" (step S23). If it is determined that the engine is operating in the region of intermediate or low air intake ($P<P_1$), then the flag D is set to "0" (step S24). The flag D when set to "1" indicates that the fuel injection pulse is to be decided in accordance with the D-J system, just as in the first embodiment.

Let us consider a case where the engine makes a transition from the operation region of low air intake to that of intermediate air intake, and then from this operating to that of high air intake.

In Operating Region of Low Air Intake

In this operating region, $P<P_2$ will hold or $P2\leqq P\leqq P_1$ and $N\leqq N_0$ will hold, as depicted in FIG. 8. If the engine is operating in this region, the flag D is set to "0" through steps S22, S24, and a flag M indicative of the region of low air intake is set to "0" through steps S22, S24 or steps S25, S26, S28. Further, the pulse width $\tau_L$ in accordance with the L-J system is calculated through steps S29, S30. Naturally, $\tau_L$ takes into account the correction C based on engine coolant temperature and the like, as in the first embodiment. Since the flag M is "0" after $\tau_L$ is calculated, the program advances from step S31 to step S36, at which fuel is injected for a period of time corresponding to the L-J system pulse width $\tau_L$. Thus, neither learning of the corrective value $\Delta\tau_D$ nor calculation of $\tau_D$ is performed in the operating region of low air intake.

In Operating Region of Intermediate Air Intake

In this operating region, $P2\leqq P\leqq P1$ and $N\geqq N_0$ will hold. If the engine is operating in this region, the flag D is set to "0" through steps S21, S22 and S24, and a flag M indicative of the region of intermediate air intake is set to "1" through steps S25, S26 and S27. Further, the pulse width $\tau_L$ in accordance with the L-J system is calculated through steps S29, S30. The D-J system pulse width $\tau_{DO}$ is calculated through the steps S31, S32, and the corrective value $\Delta\tau_D$ is learned based on $\tau_L$ and $\tau_{DO}$ through the steps S33, S34, S35. Fuel is injected for a period of time corresponding to the pulse width of $\tau_L$ at a step S36. Thus, when the engine is operating in the area of intermediate air intake, the corrective value $\Delta\tau_D$ is learned, in order to prepare for the transition to the operating regin of high air intake, while fuel injection control is being executed in accordance with the L-J system.

In Operating Region of High Air Intake

In this operating region, $P \geqq P1$ will hold. If the engine is operating in this region, a flag D indicative of the operating region of high air intake is set to "1" through steps S21, S22 and S23. Further, the pulse width $\tau_{DO}$ in accordance with the D-J system is calculated through steps S23, S32. Next, through steps S33, S37, $\tau_D$ is corrected on the basis of the stored $\Delta\tau_D$ learned in the region of intermediate air intake. Fuel is injected at step S38 in accordance with $\tau_D$ following the correction. Thus, engine control is made more efficient since the unnecessary learning and L-J system $\tau_L$ computation are not performed in the region of high air intake.

Advantages of First and Second Embodiments

In the vane-type sensor 16 employed in the first and second embodiments in order to sense the amount of intake air, the force of a spring biasing the measurement vane is decided in such a manner that measurement can be performed only up to a portion of the region of high intake air flow rate in order that there will be no increase in intake air resistance when the engine is running under a high load. In the region of high air intake, therefore, the instrument 16 cannot be used to measure the amount of intake air. Accordingly, in the region of low (or intermediate) intake air flow rate where the "relationship" between the outputs $Q_a$, $Q_b$ of the instrument 16 and sensor 14 is comparatively constant, this "relationship" between the two outputs is learned and stored as the corrective value $\Delta\tau_D$. When there is a transition to the region of high intake air flow rate, the basic fuel injection pulse $\tau_{DO}$ based on the output $Q_b$ of pressure sensor 14, which is outstanding in terms of low intake resistance, is corrected by the learned corrective value $\Delta\tau_D$, thereby making it possible to perform highly accurate fuel control even in the region of high intake air flow rate.

Modification of Embodiments

Fuel injection control in the first and second embodiments was performed in accordance with a digital program. However, the control shown in FIGS. 4 and 6 can also be executed in analog fashion. In such case, the blocks 31, 32, 41, 42 would be replaced by well-known analog computers for the L-J and D-J systems. Furthermore, the blocks 33, 44 can be replaced by memories, gates, dividers or the like, the blocks 34, 46 by multipliers or the like, and the blocks 35, 45 by selectors or the like. In other words, besides program control, fuel control in accordance with the invention can be realized by electronic circuitry comprising individual electronic components.

Further, in the first and second embodiments, correction based on learning is applied to the pulse width $\tau_{DO}$. However, as described above in connection with FIG. 1, an arrangement can be adopted in which the "relationship", which is indicative of the amount of intake air per engine revolution, between the signal $Q_a$ from instrument 16 and the signal $Q_b$ from sensor 14 is learned, and $Q_b$ is corrected when there is a transition to the operating region of high air intake.

Figure 9A:
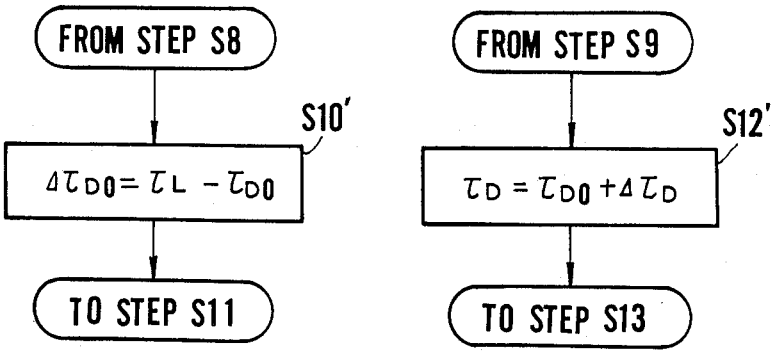
FIGS. 9A, 9B are modifications of corrective value calculated steps in the first and second embodiments, respectively.
Figure 9B:
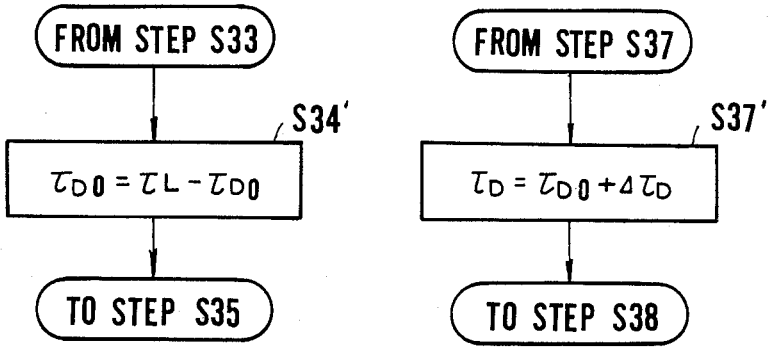

In addition, the relationship between these two types of control is expressed in terms of the fuel injection pulse "ratio" $\tau_L/\tau_{DO}$. However, as shown in FIGS. 9A and 9B, the relationship can also be expressed in terms of a difference. In this case, steps S10, S12 in the control procedure of FIG. 5 are revised to steps S10', S12' in FIG. 9A, and steps S34, S37 in the control procedure of FIG. 7 are revised to steps S34', S37' in FIG. 9B.

Further, a Karman vortex-type or hot-wire type inflow air measuring instrument can be used instead of the vane-type to measure the amount of intake air in the region of low intake air flow rate. Since these other two instruments have a low flow passage resistance, unlike the vane-type instrument, the output signals thereof can be used to judge the operating region.

It is also permissible to replace the intake air pipe pressure sensor 14 with a sensor for sensing the opening of the throttle 13, and to calculate the amount of intake air based on the throttle opening signal. Also, a negative pressure sensor (boost pressure sensor) can be used in place of the pressure sensor 14.

Furthermore, it is possible to adopt an arrangement in which the air-fuel ratio in each operating state of the engine is sensed by the oxygen sensor 21 and the amount of fuel injected is subjected to feedback control so as to obtain the optimum air-fuel ratio.

As many apparently widely different embodiments of the present invention can be made without departing from the spirit and scope thereof, it is to be understood that the invention is not limited to the specific embodiments thereof except as defined in the appended claims.

What is claimed is:

1. An apparatus for electronically controlling an amount of fuel injected into an engine, comprising:

fuel injection means for injecting fuel to be supplied into an engine;

flow rate sensing means arranged in an intake air passageway for sensing the flow rate of air taken into the engine and outputting a first flow rate signal;

flow rate signal calculating means for calculating and outputting, on the basis of a signal related to engine load, a second flow rate signal representing the flow rate of air taken into the engine;

engine rotational speed sensing means for sensing rotational speed of the engine;

decision means for determining whether the general flow rate of air taken into the engine is high or low;

first fuel injection amount calculating means for calculating a first fuel injection amount value based on the first flow rate signal and engine rotational speed;

second fuel injection amount calculating means for calculating a second fuel injection amount value based on the second flow rate signal and engine rotational speed;

arithmetic and memory means operable when said decision means determines that the general air flow rate is low for calculating and storing a relationship between a first unit intake air flow rate per unit of engine revolution calculated based on the first flow rate signal and a second unit intake air flow rate per unit of engine revolution calculated based on the second flow rate signal;

corrective value computing means for calculating a corrective value of fuel injection amount based on the relationship stored in said arithmetic and memory means; and control means for performing control in such a manner that said fuel injection means injects fuel based on the first fuel injection amount value when said decision means determines that the general air flow rate is low and based on the second fuel injection amount value and corrective value when said decision means determines that the general air flow rate is high.

2. The apparatus according to claim 1, wherein said arithmetic and memory means is connected to said first and second fuel injection amount computing means and stores a relationship between the values of the first and second fuel injection amounts instead of the relationship between the first and second unit intake air flow rates.

3. The apparatus according to claim 1, wherein said relationship is expressed by a ratio of the first unit intake air flow rate to the second unit intake air flow rate.

4. The apparatus according to claim 1, wherein said relationship is expressed by a difference between the first and second unit intake air flow rates.

5. The apparatus according to claim 1, wherein whenever said decision means determines that the general flow rate of air is low, said arithmetic and memory means calculates and stores an average of a value indicative of the relationship calculated and stored in a previous cycle and a value indicative of the relationship calculated in the current cycle.

6. The apparatus according to claim 1, wherein said decision means determines whether the general flow rate of air is high or low based on the value of first flow rate signal or second flow rate signal.

7. The apparatus according to claim 1, wherein said decision means includes comparator means connected to said flow rate signal calculating means and said engine rotational speed sensing means for comparing the value of general air flow rate, obtained based on the value of the second flow rate signal and engine rotational speed, with first and second threshold values, said arithmetic and memory means operating only when said decision means determines that the value of general flow rate of air lies in a region between the first and second threshold values.

8. The apparatus according to claim 1, wherein said second flow rate signal is an intake air pressure value downstream of a throttle valve, or a throttle valve opening value.

9. A method of electronically controlling an amount of fuel injected to be supplied into an engine, comprising:

a first step of determining whether a general flow rate of air taken into an engine is high or low;

a second step of executing the following steps (a) through (f) when the general flow rate of air is determined to be low in said first step:

(a) measuring the flow rate of air taken into the engine through an intake air passageway;

(b) calculating the flow rate of intake air supplied to the engine on the basis of a signal relating to engine load;

(c) calculating a first unit intake air amount per unit revolution of the engine based on the amount of intake air measured in said step (a), calculating a second unit intake air amount per unit revolution of the engine based o the amount of intake air calculated in said step (b), and calculating a relationship between said first and second unit intake air amounts;

(d) storing the relationship calculated;

(e) calculating a first fuel injection amount based on the intake air amount calculated in said step (a) and engine rotational speed; and (f) injecting fuel from fuel injection means based on the first fuel injection amount; and a third step of executing the following steps (p) through (s) when the the general flow rate of air is determined to be high in said first step:

(p) calculating the flow rate of air taken into the engine based on a signal relating to engine load;

(q) correcting the intake air flow rate calculated in said step (p) based on the relationship stored in said step (d);

(r) calculating a second fuel injection amount based on the corrected intake air flow rate and engine rotational speed; and (s) injecting fuel from the fuel injection means based on the second fuel injection amount.

10. The method according to claim 9, wherein said relationship calculated in said step (c) is expressed by a ratio of said first unit intake air flow rate to said second unit intake air flow rate.

11. The method according to claim 9, wherein said relationship calculated in said step (c) is expressed by a difference between said first and second unit intake air flow rates.

12. The method according to claim 9, wherein said step (d) includes calculating and storing an average of a value indicative of the relationship stored in said step (d) of a previous cycle and a value indicative of the relationship calculated in said step (c) of a current cycle.

13. The method according to claim 9, wherein said first step includes determining whether the general flow rate of air is high or low by comparing the value of the signal relating to engine load with a predetermined threshold value.

14. The method according to claim 9, wherein said signal relating to engine load in said step (a) is a value indicative of pressure in an intake pipe downstream of a throttle valve of the engine, or a value indicative of throttle valve opening.

15. The method according to claim 9, wherein said step (d) includes determining whether the general flow rate of air, obtained based on the value of the signal relating to the engine load and engine rotational speed, is in a region of intermediate values, and storing said relationship only when it is determined that the general flow rate of air is in said region of intermediate values.

* * * * *